United States Patent [19]

Clinton

[11] 4,233,924

[45] Nov. 18, 1980

[54] UNDERWATER CRAFT LAUNCH TUBE

[75] Inventor: John S. Clinton, Bourne End, England

[73] Assignee: The British Petroleum Company Limited, London, England

[21] Appl. No.: 895,996

[22] Filed: Apr. 13, 1978

[51] Int. Cl.[3] ..... B63B 35/40

[52] U.S. Cl. ..... 114/259; 405/185

[58] Field of Search ..... 114/125, 270, 244, 245, 114/121, 122, 258, 259; 405/185, 194; 181/233

[56] References Cited

U.S. PATENT DOCUMENTS

| | | | |
|---|---|---|---|
| 3,148,745 | 9/1964 | Jones | 181/233 |
| 3,212,602 | 10/1965 | Jones et al. | 181/233 |
| 3,499,410 | 3/1970 | Field et al. | 114/125 |
| 3,641,961 | 2/1972 | Howard | 405/185 |

FOREIGN PATENT DOCUMENTS

| | | | |
|---|---|---|---|
| 1179297 | 1/1970 | United Kingdom | 405/185 |
| 1226319 | 3/1971 | United Kingdom | 405/185 |

*Primary Examiner*—Sherman D. Basinger

*Attorney, Agent, or Firm*—Morgan, Finnegan, Pine, Foley & Lee

[57] ABSTRACT

Diving bell launch tube has a vertical passageway having a surrounding surge chamber adjacent to the water surface. The surge chamber communicates with the passageway through perforations and the holes of the perforated section are tuned with respect to the surge chamber volumes to achieve damping of water oscillation in the tube.

14 Claims, 4 Drawing Figures

RUN(a)
METRES
4.00
0.00
-4.00
SURGE CHAMBER
20.0
TIME IN MINUTES (FULL SCALE - LINEAR)
5.00
0.00
-5.00
WAVE AMIDSHIP
20.0
TIME IN MINUTES (FULL SCALE - LINEAR)
RUN(b)
METRES
4.00
0.00
-4.00
SURGE CHAMBER
20.0
TIME IN MINUTES (FULL SCALE - LINEAR)
4.00
0.00
-4.00
WAVE AMIDSHIP
20.0
TIME IN MINUTES (FULL SCALE - LINEAR)
RUN(c)
METRES
4.00
0.00
-4.00
SURGE CHAMBER
40.0
TIME IN MINUTES (FULL SCALE - LINEAR)
5.00
0.00
-5.00
WAVE AMIDSHIP
40.0
TIME IN MINUTES (FULL SCALE - LINEAR)

UNDERWATER CRAFT LAUNCH TUBE

The present invention relates to diving bell launch tubes and more particularly to means for facilitating the lowering and raising of the diving bell into the sea during disadvantageous sea conditions.

The use of diving bells for sub-sea operations, e.g. maintenance of pipelines, production platforms and rigs, has become of increasing importance. However, the time available for the operation is often limited because of unfavourable sea conditions. The heaving of the sea poses problems of entry of the bell into the water and can cause physical discomfort to the diving personnel thus impairing work capacity and basic safety conditions and causes serious risk of bell wire breakage.

In diving operations one method of launching a diving bell is by raising and lowering the bell through the air/sea interface in a well or shaft within a ship or vessel. In unfavourable sea conditions the pulsing of the water in the tube can buffet the bell during passage down the shaft and can prejudice the safety of the bell personnel. The present invention relates to a well or shaft which allows improved transition of the bell across this air/sea interface and which has the advantage of being a substantially passive system in that there are no or few moving parts.

Thus, according to the present invention there is provided a launch tube suitable for launching underwater craft, e.g. diving bells, the tube comprising a substantially vertical passageway having a surrounding surge chamber adjacent to the liquid surface, the surge chamber communicating with the passageway through a perforated section of the passageway, the chamber and perforations being of a size and distribution in relation to the passageway such that there is damping of liquid oscillation in the tube. The launch tube may be separate or be associated with a conventional ship, semi-submersible craft or the like.

Diving bells are preferably of the conventional type having a thick walled steel sphere enclosing the diving personnel and equipment. Preferably the sphere is supported by a tripod or leg arrangement and in operation is passed into the launching tube by a cable and winch arrangement. Also it is envisaged that manned or unmanned submersibles e.g. small submarines, may be launched via these tubes.

For use with a semi-submersible rig, the passageway of the launching tube may pass from the upper deck of the rig through the surge chamber or pontoon of the rig and thence opens into the sea proper at the keel.

It is desirable that the still sea water level lies within or just below the surge chamber and preferably is located at a point about halfway up the surge chamber.

The preforated section of the launching tube connects the interior of the passageway to the surge chamber and has preferably circular or elliptical apertures. Preferably the surge chamber has one or more diaphragm plates, either horizontal or vertical, depending on convenience, which are also perforated, preferably with circular or elliptical apertures so as to allow intercommunication between the resulting sections formed by the plates. The vertical passageway is preferably of a circular cross-section. The surge chamber may be of a similar cross-section to that of the vertical passageway or launch tube or it may be of different cross-section (e.g. square).

Around the exit of the flow tube, a supply of high pressure gas may be used to aerate the water inside the tube. A perforated high pressure air tube is preferably used. It is believed that the aeration acts by reducing the effective density of the water in the tube thereby reducing the hydrodynamic forces on the bell.

The areas of the apertures of the perforated section of the vertical passageway and the volume of the surrounding surge chamber are preferably "tuned" so as to achieve maximum damping of the oscillating column of sea water when unsteady sea conditions are present. This "tuning" may be achieved by varying the size, shape and spacing of the apertures and the shape and volume of the surge chamber. Thus it is envisaged that asymmetric apertures and surge chambers may be used.

The tuning of the surge chamber occurs in the design stage and each system is tailored to suit an individual ship or the like by observing behaviour in model test conditions. Thus, depending on the wave conditions likely to be experienced by the ship, a model test of a surge chamber is carried out to obtain optimum wave damping in the bell under the specified wave height and frequency. The surge chamber design resulting from the model tests is then scaled up and built into the operational vessel.

In general, significant wave heights and periodic times of up to 7–9 meters and 20 secs respectively may be expected to be encountered and the volume of the surge chamber is preferably from 1 to 5 times the volume of the section of passageway that it surrounds. The apertures preferably have an area of from 50 to 150% of the surface area of the section of the passageway surrounded by the surge chamber and most preferably are uniformly distributed.

The invention also includes a method of launching underwater craft into a liquid whereby (i) the craft is lowered into a launch tube and hereinbefore defined, (ii) the craft is passed through the liquid/air interface, and (iii) is passed out of the tube into the surrounding liquid.

The invention will now be described by way of example only with reference to FIGS. 1 to 4 of the accompanying drawings.

Figure 1:
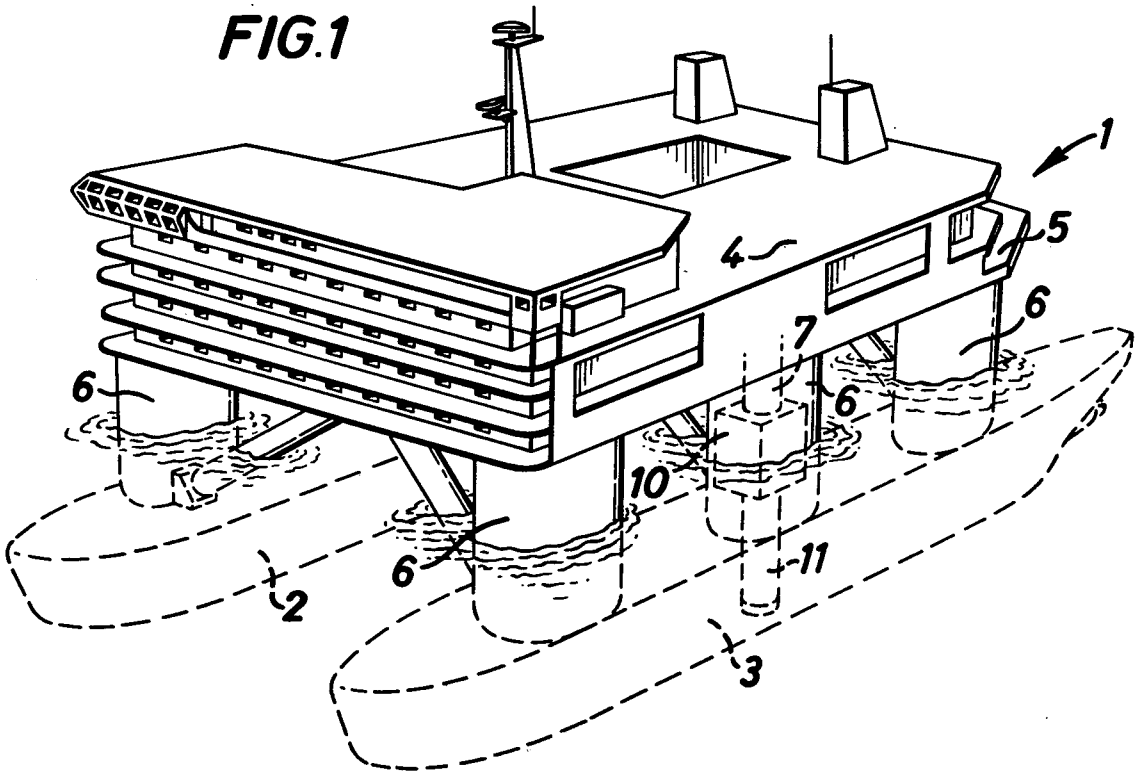
FIG. 1 shows a diagrammatic representation of a semi-submersible rig capable of accommodating a diving tube according to the invention.
Figure 2:
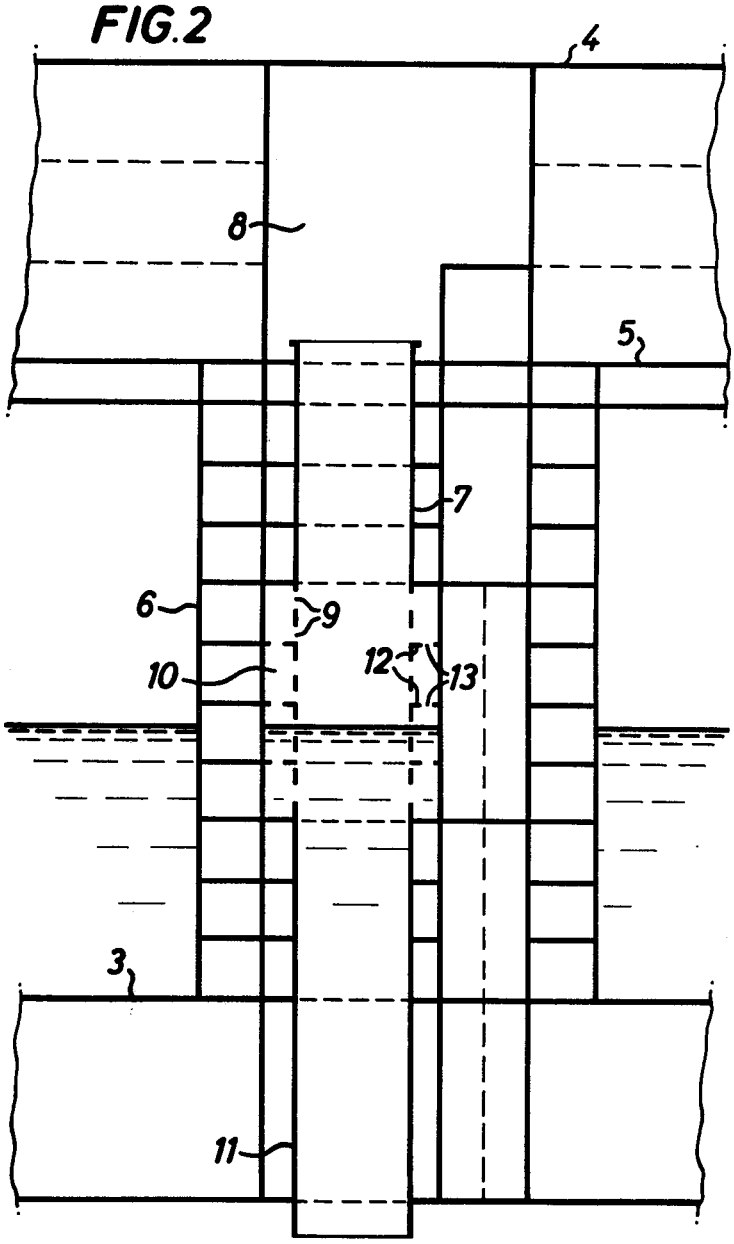
FIG. 2 shows a vertical section through the diving tube center line.
Figure 3:
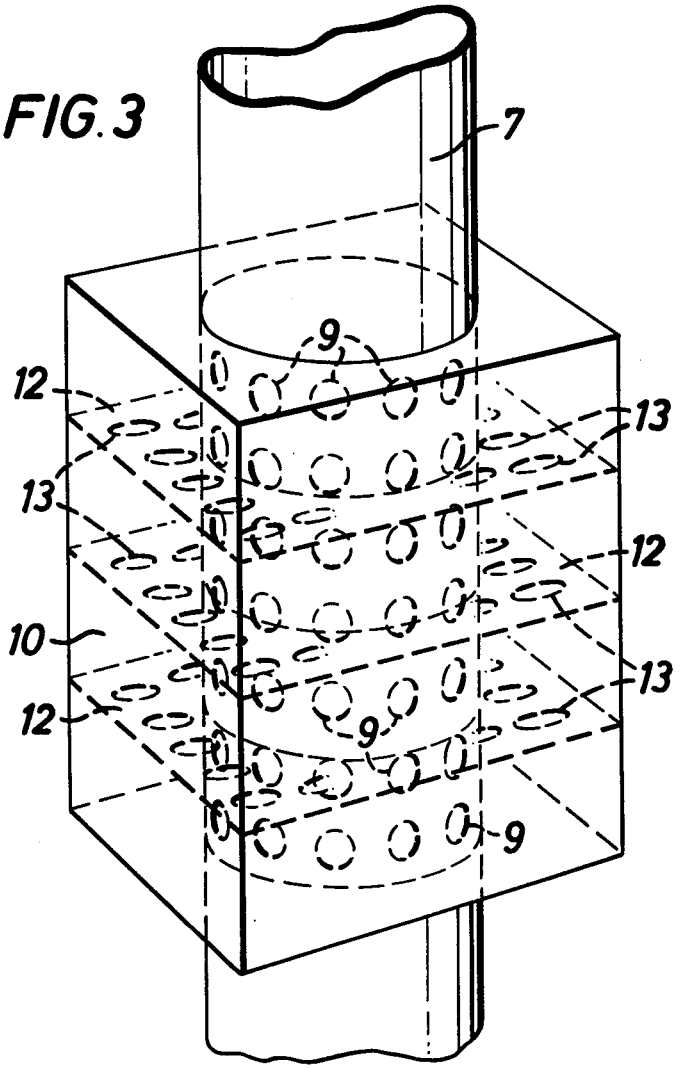
FIG. 3 shows a more detailed section of the surge chamber of FIG. 2.

A semi-submersible rig 1 (as in FIG. 1) has a pair of pontoons 2, 3 lying beneath the water surface and a main deck 4 and lower deck 5 above the water surface. Each pontoon 2, 3 is joined by three vertical supports 6 to the deck 4.

One of the supports 6 is adapted to have a vertical diving tube 7 passing between the decks and allowing access to the sea below via the pontoon 3.

At the upper end of the diving tube 7, an area 8 is provided for diving equipment and gas bottle stowage which are accessible from the decks 4, 5.

The diving tube 7 has an internal diameter of about 3 m and extends downwardly from the lower deck for a distance of about 20 m. At the sea level the diving tube 7 has a perforated section 9 about six meters long which communicates with a surrounding surge chamber 10 which takes the form of a rectangle (of side 6×4.6×5 m). The diving tube 7 then extends downwards through the pontoon 3 via a section 11 into the sea beneath the semi-submersible rig 1.

The perforated section 9 of the walls of the diving tube 7 comprise seven rows of circular cut outs, each row having 12×300 mm diameter holes. The perforated section 9 is supported inside the surge chamber 10 by three horizontal diaphragm plates 12, each plate 12 being pierced by sixteen elliptical cut outs 13 of major and minor diameters 700×350 mm which allow water flow to occur within the surge chamber 10.

During use of the diving tube, a diving bell is lowered into the tube 7 by a winch on the lower deck of the semi-submersible rig. The bell passes through the air space until it reaches the air/sea interface within the perforated section 9 of the tube 7. In steady sea conditions the bell can cross the air/sea interface and pass along the tube 7 until it reaches the sea proper. In non-steady sea conditions the oscillation of the sea level within the tube 7 is considerably damped by the action of the surge chamber 10. This reduction in sea level oscillation within the diving bell facilitates the passage of the diving bell and personnel across the air/sea interface, ie. reduces the heaving and pitching of the bell and hence increases the safety conditions under which the bell operates.

The dimensions of the surge chamber were determined from a series of model tests at a scale of 1:20. The diving tube system was built of transparent PVC plastic together with the starboard center column and 28 m of the starboard hull around the column. The perforations around the surge damping chamber were made to the correct opening areas.

A calibrated hoisting winch with variable speed was placed over the diving tube. The winch was relieved of the constant weight of the bell by means of a contra weight.

Around the orifice at the bottom exit of the diving tube an 8 mm diameter (model scale) aeration tube was fitted with 18 1 mm holes equally spaced on the inner side pointing 30° downward. Compressed air was led to the aeration tube through a flowmeter. The air flow was calibrated to a constant value of $1.58\times10^{-4}$ m$^3$/s corresponding to a full scale value of:

$$Q=1.58\times10^{-4}\times20^{5/2}=0.28\ \text{m}^3/2=600\ \text{ft}^3/\text{min}$$

The whole diving tube system model was fitted to an SL vertical planar motion mechanism in order to simulate heave motions of different amplitudes and frequencies.

The diving bells were manufactures of wood and copper tube in accordance with drawings. A pyramid shape frame was mounted on top of the bell in order to ease the re-entry into the diving tube. The diving bells were ballasted with lead weights to simulate the weight of the full scale bell to be used. Due to small volume differences between models and prototypes, it was not possible to match weights in air and water exactly.

The waves were produced by a digitally controlled pneumatic wave maker.

Figure 4:
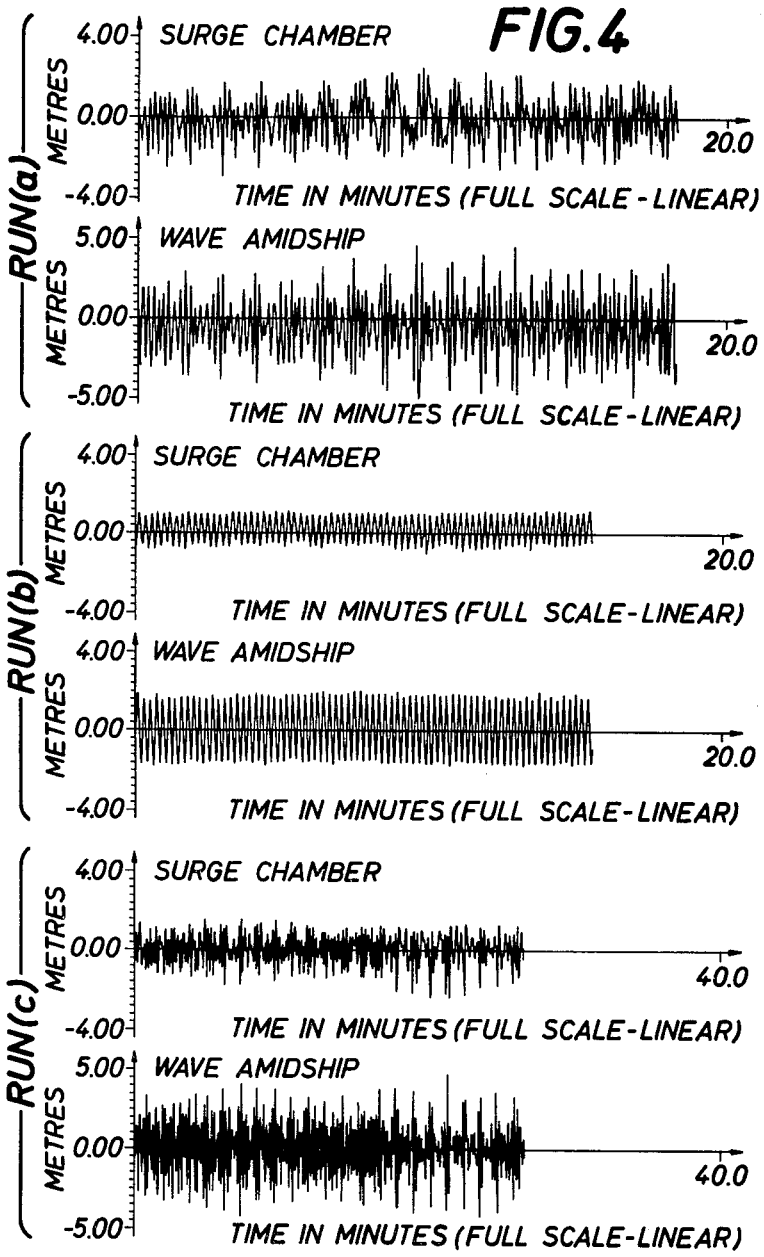
FIG. 4 shows recorded spectra of wave height and time for waves amidships of the rig and for waves in a launch tube fitted with a surge chamber.

FIG. 4 shows pen recordings of wave height against time of typical model tests of the surge chamber when subjected to waves (a) at 84% of full operating draught with irregular waves having $T_{mean}=10.33$ secs and $H_{\frac{1}{3}}=6.71$ meters where $T_{mean}$ is the mean time period of the waves and $H_{\frac{1}{3}}$ is the significant wave height, (b) at 100% full operating draught with regular waves having $T_{mean}=12.5$ secs and $H_{\frac{1}{3}}=3.6$ meters and (c) at 100% full operating draught with irregular waves having $T_{mean}=10.27$ secs and $H_{\frac{1}{3}}=5.89$ meters. The ordinates are in meters and the abscissa is the time of full scale and not model scale. The runs (a), (b) and (c) illustrate the marked reduction in wave height which occurs in the diving chamber within the vessel compared to the wave height outside and amidships of the vessel.

I claim:

1. A launch tube for passing an underwater craft through an air/liquid interface comprising a substantially vertical passageway having a surrounding surge chamber adjacent to the air/liquid interface, the surge chamber communicating with the passageway through a perforated section of the passageway, the chamber and perforations being of a size and distribution in relation to the passageway such that there is damping of liquid oscillation in the tube.

2. A launch tube according to claim 1 in which the perforated section of the vertical passageway has circular or elliptical apertures.

3. A launch tube according to claim 2 in which the surge chamber has one or more perforated diaphragm plates.

4. A launch tube according to claim 3 in which the diaphragm plates are horizontal.

5. A launch tube according to claim 4 in which the perforated diaphragm plates have elliptical or circular apertures.

6. A launch tube according to claim 2 in which the apertures have an area of from 50 to 150% of the surface area of the section of the passageway surrounded by the surge chamber.

7. A launch tube according to claim 1 in which the surge chamber and the vertical passageway have a circular cross-section.

8. A launch tube according to claim 1 in which the volume of the surge chamber is from 1 to 5 times the volume of the section of vertical passageway surrounded by the surge chamber.

9. A launch tube according to claim 1 adapted for use with a diving bell.

10. Water going craft having a launch tube according to claim 1.

11. A method of launching an underwater craft through an air/liquid interface comprising the steps of (i) lowering the craft into an underwater craft launch tube comprising a substantially vertical passageway having a surrounding surge chamber adjacent to the air/liquid interface, the surge chamber communicating with the passageway through a perforated section of the passageway, the chamber and perforations being of a size and distribution in relation to the passageway such that there is damping of liquid oscillation in the tube, (ii) passing the craft through the air/liquid interface in the surge chamber, and (iii) passing the craft out of the launch tube into the surrounding liquid.

12. A launch tube according to claim 1 in which the surge chamber has one or more perforated diaphragm plates.

13. A launch tube according to claim 12 in which the diaphragm plates are horizontal.

14. A launch tube according to claim 12 in which the perforated diaphragm plates have elliptical or circular apertures.

* * * * *